US006223783B1

(12) United States Patent
Peeters et al.

(10) Patent No.: US 6,223,783 B1
(45) Date of Patent: May 1, 2001

(54) FILLING INSERTION SYSTEM FOR AN AIR JET WEAVING MACHINE

(75) Inventors: Jozef Peeters, Ypres; Joseph Verhulst, Zillebeke, both of (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/424,236

(22) PCT Filed: May 26, 1998

(86) PCT No.: PCT/EP98/03077

§ 371 Date: Mar. 15, 2000

§ 102(e) Date: Mar. 15, 2000

(87) PCT Pub. No.: WO98/54385

PCT Pub. Date: Dec. 3, 1998

(30) Foreign Application Priority Data

May 28, 1997 (BE) ..... 9700465

(51) Int. Cl.[7] ..... D03D 47/28
(52) U.S. Cl. ..... 139/435.4; 28/271
(58) Field of Search ..... 139/435.4; 28/271

(56) References Cited

U.S. PATENT DOCUMENTS 3,519,030 * 7/1970 Vermeulen ..... 139/435.4
4,957,144 * 9/1990 Watanabe et al. ..... 139/435.4
5,111,852 * 5/1992 Verhulst ..... 139/435.4

* cited by examiner

*Primary Examiner*—Andy Falik
(74) *Attorney, Agent, or Firm*—Bacon & Thomas PLLC

(57) ABSTRACT

A filling insertion system for a weaving machine includes a holder (8) for at least two nozzles (10, 11, 50). Each of the nozzles (10, 11, 50) includes a feed connection (20, 21, 52) for a pressurized fluid. The feed connections (20, 21, 52) are all arranged on the same side (15) of the holder (8) and are space apart from each other along the direction of the longitudinal axes (30, 31, 54) of the nozzles (10, 11, 50).

10 Claims, 12 Drawing Sheets

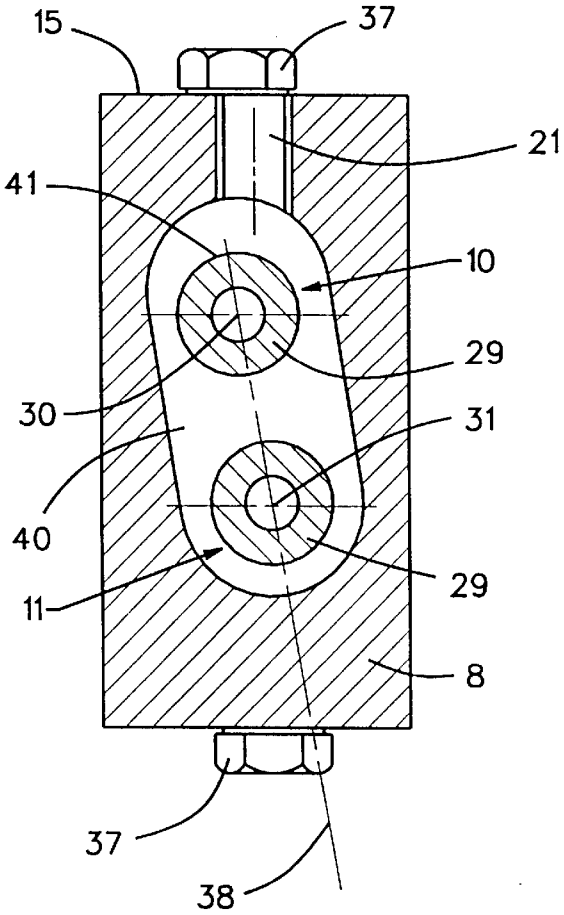
FIG. 9
FIG. 8
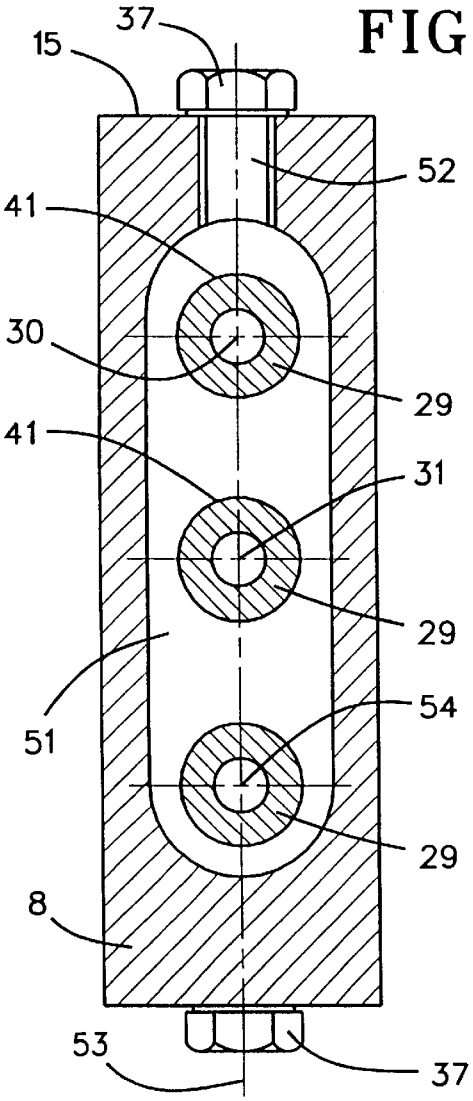

FILLING INSERTION SYSTEM FOR AN AIR JET WEAVING MACHINE

BACKGROUND OF THE INVENTION

1. Field of the Invention

The invention relates to an insertion system for a weaving machine comprising at least two nozzles mounted on a common holder and each having one intake for a filling yarn and each associated with a feed connection for a pressurized-medium.

2. Description of the Related Art

As regard to the insertion systems of the above kind, the pressurized-medium feed connections are always mounted in the vicinity of an injector segment on different sides of the holder. Depending on the number of nozzles, the feed connections are located at the top side, the bottom side, or also laterally, on the holder. Consequently feed lines connected to the connections must cross each other. The nozzle-configured insertion system, being mounted on the batten and moving together with it, causes the feed lines connecting the feed connections to stationary sources to rest and rub against each other. This rubbing may damage the feed lines and cause leaks.

SUMMARY OF THE INVENTION

The objective of the invention is to design an insertion system of the above kind wherein the feed lines can be arranged whereby the feed lines are least likely to touch and rub against each other.

This problem is solved by mounting the feed connections for the pressurized fluid in a spaced apart relationship along the longitudinal direction of the nozzles on the same side of the holder and by providing channels in the holder so that a channel extends from each feed connection to each nozzle.

The invention has the advantage that the pressurized-medium feed lines leading to the feed connections can be arranged as a system while substantially reducing the danger of the feed lines touching and rubbing against each other. Furthermore the insertion system as a whole is made compact. The invention is most advantageous when used with several nozzles.

Preferably, the feed connections are located in a plane containing the longitudinal axes of the associated nozzles. Because of this arrangement, the holder may preferably be made relatively narrow, and as a result several nozzles can be compactly mounted in one holder or several holders may be closely mounted next to one another on the batten of a weaving machine.

In the design of the invention, the holder is provided with clearances extending in the direction of the filling threads and receives the nozzles, and comprise a segment containing an injector, the segment being positioned between a filling insertion-element and a guide tube, the segment being sealed from the insertion element and the guide tube, or from a subsequent guide element, along the longitudinal direction of the clearance and being connected by a channel to a feed connection. Preferably, the channel leading from a feed connection to a nozzle positioned farther away will enclose the nozzles positioned more closely within one segment sealed in the longitudinal nozzle direction. In this manner the channels do not require undue space in a direction transverse to the plane of the nozzles' longitudinal axes.

In a first embodiment of the invention, a holder is provided with sets of nozzles superposed or adjacent to each other in substantially parallel planes. In this manner a very compact insertion system can be created, wherein the feed connections for all the nozzles are systematically mounted on the same side.

In another embodiment, a holder is provided with two or more superposed nozzles positioned in a substantially vertical plane. Such a holder is substantially narrow. Therefore, in another advantageous embodiment, several holders each having at least two nozzles are mounted adjacent to each other and the feed connections are mounted at the top sides of the holders. As a result a very compact insertion system is made possible, which may be configured in a modular manner with several holders and a corresponding plurality of nozzles. Additionally and advantageously, the holders when seen from above will taper in the direction of the filling threads and abut each other on their lateral surfaces. As a result, a plurality of nozzles can be aligned relatively accurately with a guide channel, in particular, an air guiding channel in the reed.

BRIEF DESCRIPTION OF THE DRAWINGS

Further features and advantages of the invention are described in the following description of the illustrative embodiments that are shown in the drawings and in the appended claims.

FIG. 8 is a sectional view along line VIII—VIII of FIG. 7,

FIG. 9 is a sectional view similar to FIG. 2 of yet another embodiment,

DETAILED DESCRIPTION OF THE PREFERRED EMBODIMENTS

Figure 1:
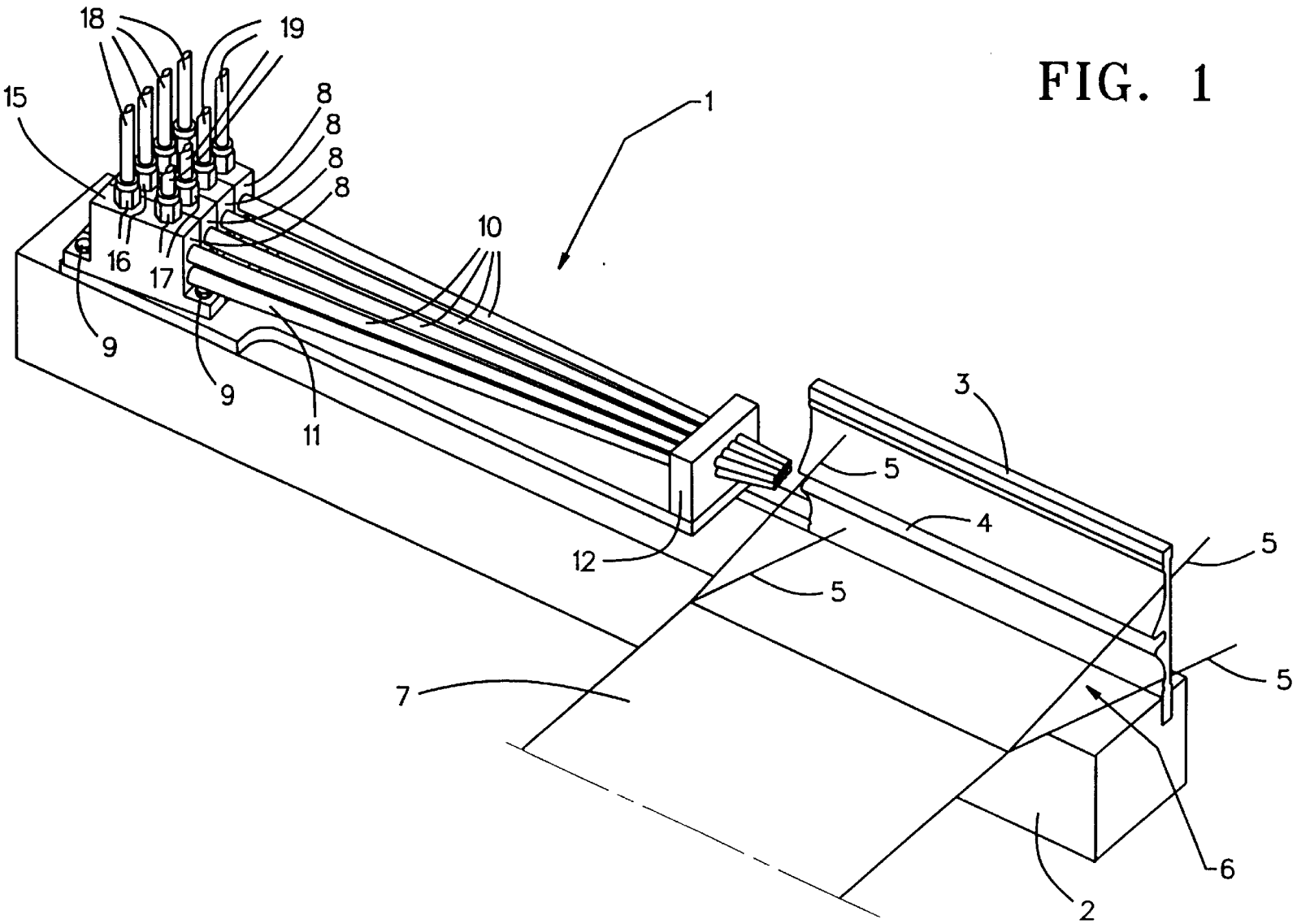
FIG. 1 schematically shows a perspective view of a portion of an airjet weaving machine provided with an insertion system of the invention.

FIG. 1 shows an insertion system 1 mounted on a batten 2 of an airjet weaving machine. The batten 2 supports a reed 3 provided with an air guidance channel 4 to guide the inserted filling threads. A shed 6 is formed in the region defined by the reed 3 and the warp threads 5, with filling threads being inserted into the shed 6 which are then beaten against the fell of a fabric 7.

The insertion system comprises several holders 8—in this embodiment, four holders—each are secured to a base plate, which in turn, is fastened to the batten 2 by screws 9. Each holder supports two nozzles 10, 11 which can move together with the batten 2. The nozzles 10, 11 are called the main nozzles in airjet weaving machines. The ends of the nozzles 10, 11, positioned away form the holders 8 are secured by a mount 12 to the base plate.

Two connectors 16, 17 are provided at the top side 15 of each holder 8 to feed each of the nozzles 10, 11 with compressed air. Feed lines 18, 19 are hooked-up to the connectors 16, 17. The feed lines 18, 19 in this embodiment run substantially vertically in the region of the connectors 16, 17. They are mounted mutually apart and mutually parallel and are hooked up by valves (not shown) to a source of compressed air (also not shown). In another embodiment (not shown), the connectors 16, 17 may preferably be integrated into the holder 8.

FIGS. 2 through 5 are sectional views of a holder 8 comprising two nozzles 10, 11 mounted one above the other. The nozzles 10, 11 are identical. The holder 8 is provided with a feed connection 20, 21 for each nozzle 10, 11. Each nozzle 10, 11 comprises a filling thread insertion element 28 provided with an intake 22 for a filling thread (not shown). The insertion element 28 adjoins a guide element 29 which together with the insertion element forms an injector. The guide element 29 is followed by a guide tube 24 having an outlet 26 for the compressed air and the ejected filling thread (not shown). The axes of the insertion element 28 and the guide element 29 run substantially coaxially with the axes of the guide tubes 24, and thus define the longitudinal axes 30, 31 of the nozzles 10, 11. Filling threads run substantially along the longitudinal axes 30, 31, through the nozzles 10, 11 and hence, these longitudinal axes 30, 31 determine the direction of motion A of the filling threads.

The outside surface 32 of the insertion element 28 is provided with radial protrusions 33. By means of an inside surface 34, the guide element 29 spans the outside surface 32 of the insertion element 28 in the region of the protrusions 33 and as a result, the pressurized fluid is introduced between the outside surface 32 of the insertion element 28 and the inside surface 34 into the guide element 29. The inside surface 34 rests against the protrusions 33 and thereby the guide element 29 is lined up in the axial extension of the insertion element 28. The insertion element 28 and the guide element 29 constitute an injector for guiding a filling thread from the intake 22, through the borehole 35 of the insertion element 28, and then through a borehole 36 of the guide element 29 and through the guide tube 24. By means of screws 37, the insertion element 28 and the guide element 29 are secured to the holder 8 to prevent axial displacement.

Figure 2:
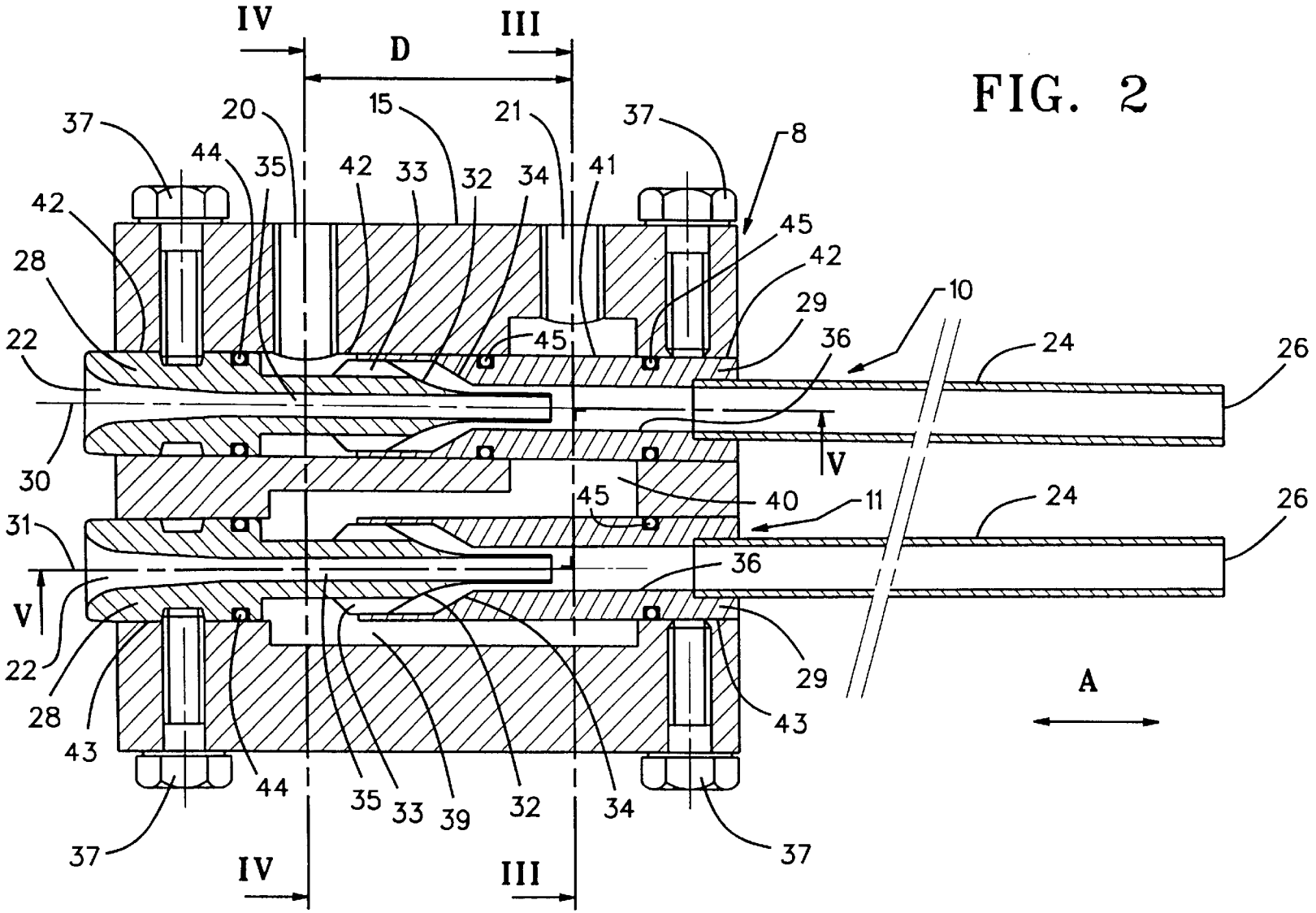
FIG. 2 is an exploded sectional view of the nozzle in the longitudinal direction of a holder of the insertion system of FIG. 1, on a larger scale.
Figure 4:
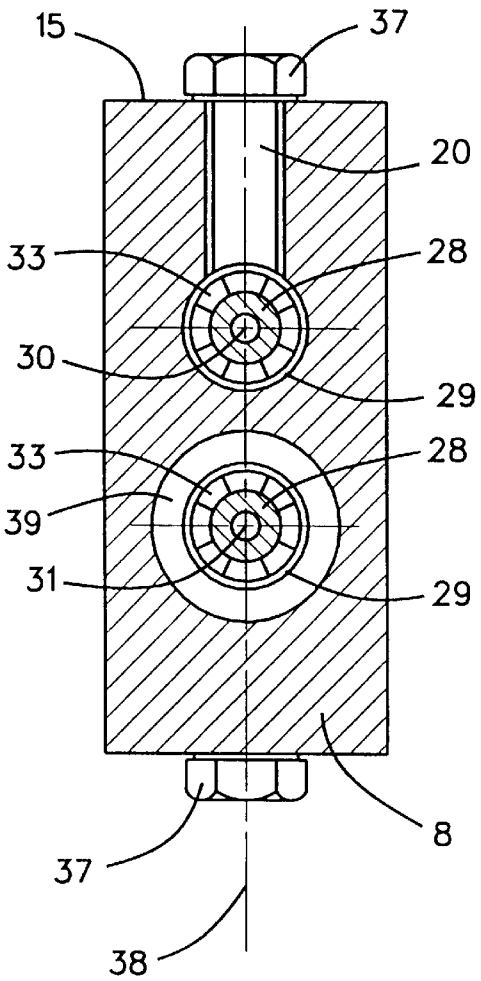
FIG. 4 is a sectional view along line IV—IV of FIG. 2.
Figure 3:
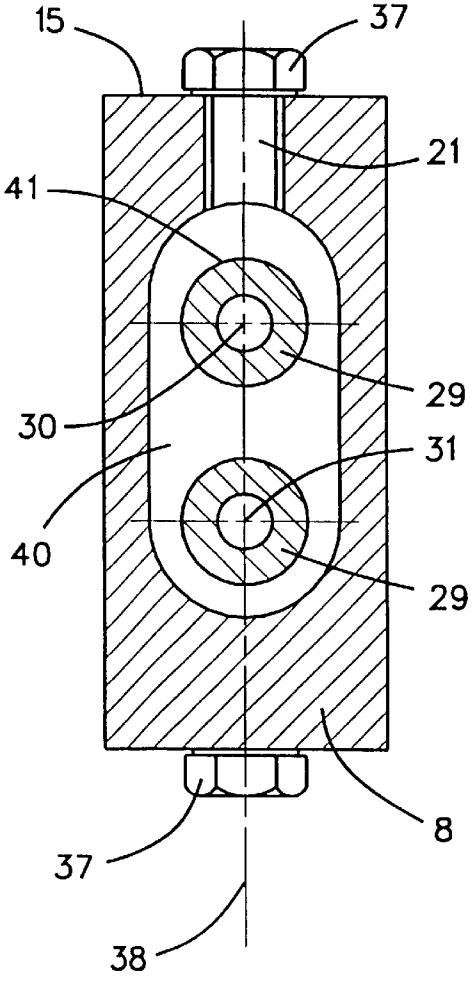
FIG. 3 is a sectional view along line III—III of FIG. 2.

The feed connections 20, 21 for the two superposed nozzles 10, 11 are positioned on the same side 15 of the holder 8, as shown in FIGS. 1 through 4, primarily at the top side 15 of the holder 8. As shown in FIGS. 3 and 4, the feed connections 20, 21 are positioned in a plane 38 also containing the longitudinal axes 30, 31 of the two nozzles 10, 11. This plane 38 is a plane of symmetry of the holder 8. As shown by FIG. 2, the feed connections 20, 21 are mounted mutually apart in the direction of the longitudinal axes 30, 31 of the nozzles 10, 11.

The insertion element 28 and the guide element 29 of the two nozzles 10, 11 respectively are placed in axial clearances 42, 43, wherein they are secured by the screws 37. The feed connection 20 associated with the nozzle 10 directly communicates with a segment of this nozzle wherein the injector begins. This segment is sealed from the outside by two O-rings 44, 45. The outside diameter of the insertion element 28 is decreased within this segment to form an annular chamber from which the pressurized medium flows into the guide element 29. The feed connection 21 for the nozzle 11 communicates, through a channel consisting of two segments 39, 40 of the holder 8, with the segment of the nozzle 11 where the injector is located. As shown by FIG. 3, the channel segment 40 encloses the nozzle 10 in the region of a segment 41 of the guide element 29. To prevent the pressurized fluid from leaking into this region, another O-ring 45 is used which seals this channel segment 40 from the outside in the region of the guide element 29. The channel segment 39 extends the segment 40, initially running radially to the nozzles 10, 11, and then in the axial direction coaxially with the nozzle axis 31, whereby the pressurized fluid again flows to that segment of the nozzle 11 where the injector is located. The guide element 29 of the nozzle 11 is sealed from the outside by another O-ring 45.

In the embodiment of FIGS. 1 through 5, the holder is made by casting, for instance via diecasting, or injection molding, including the channel segments 39, 40. The clearances 42, 43, as well as corresponding apertures for the feed connections 20, 21 may preferably be made in this manner, although they must be subsequently finished.

Figure 5:
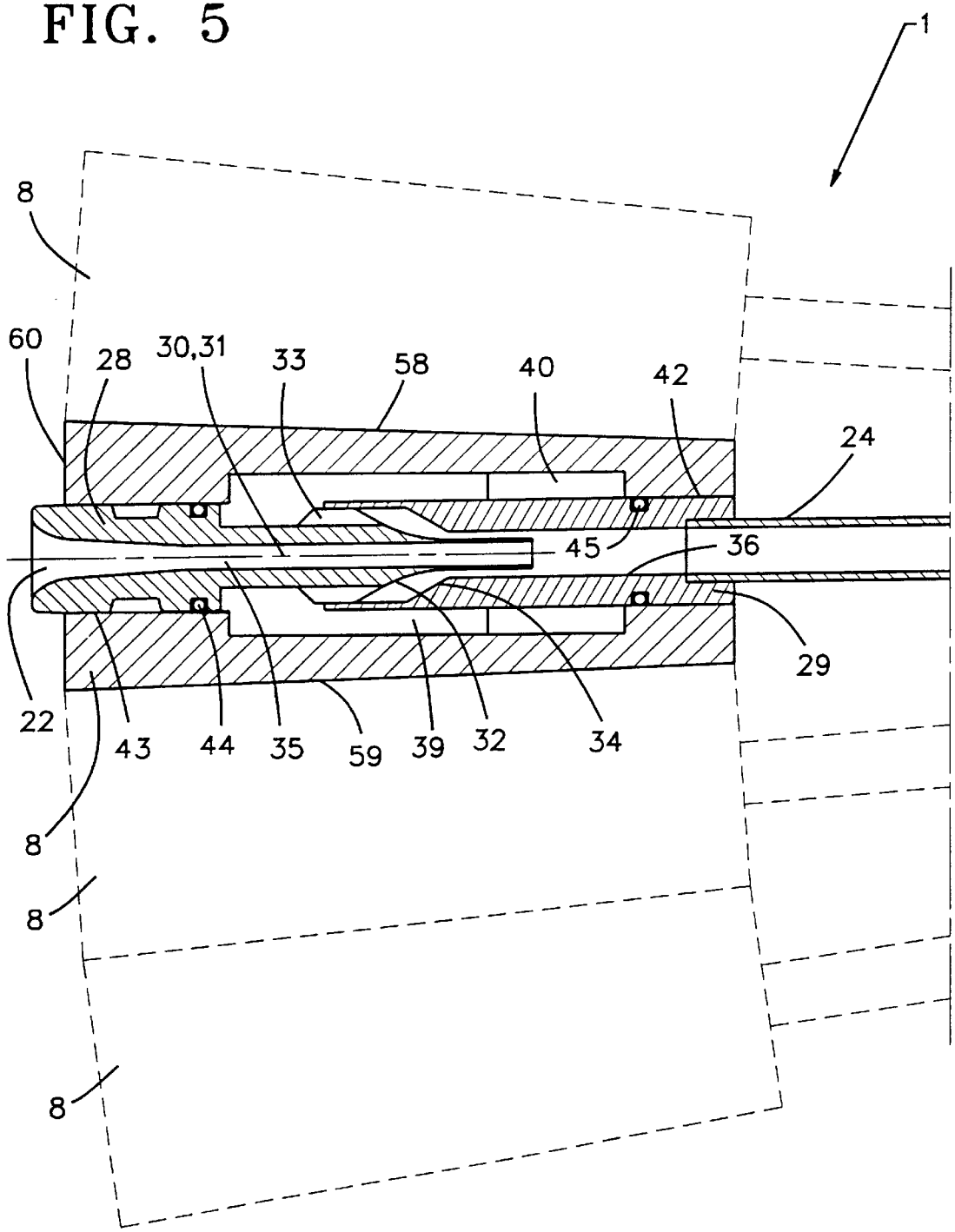
FIG. 5 is a sectional view along line V—V of FIG. 2.
Figure 6:
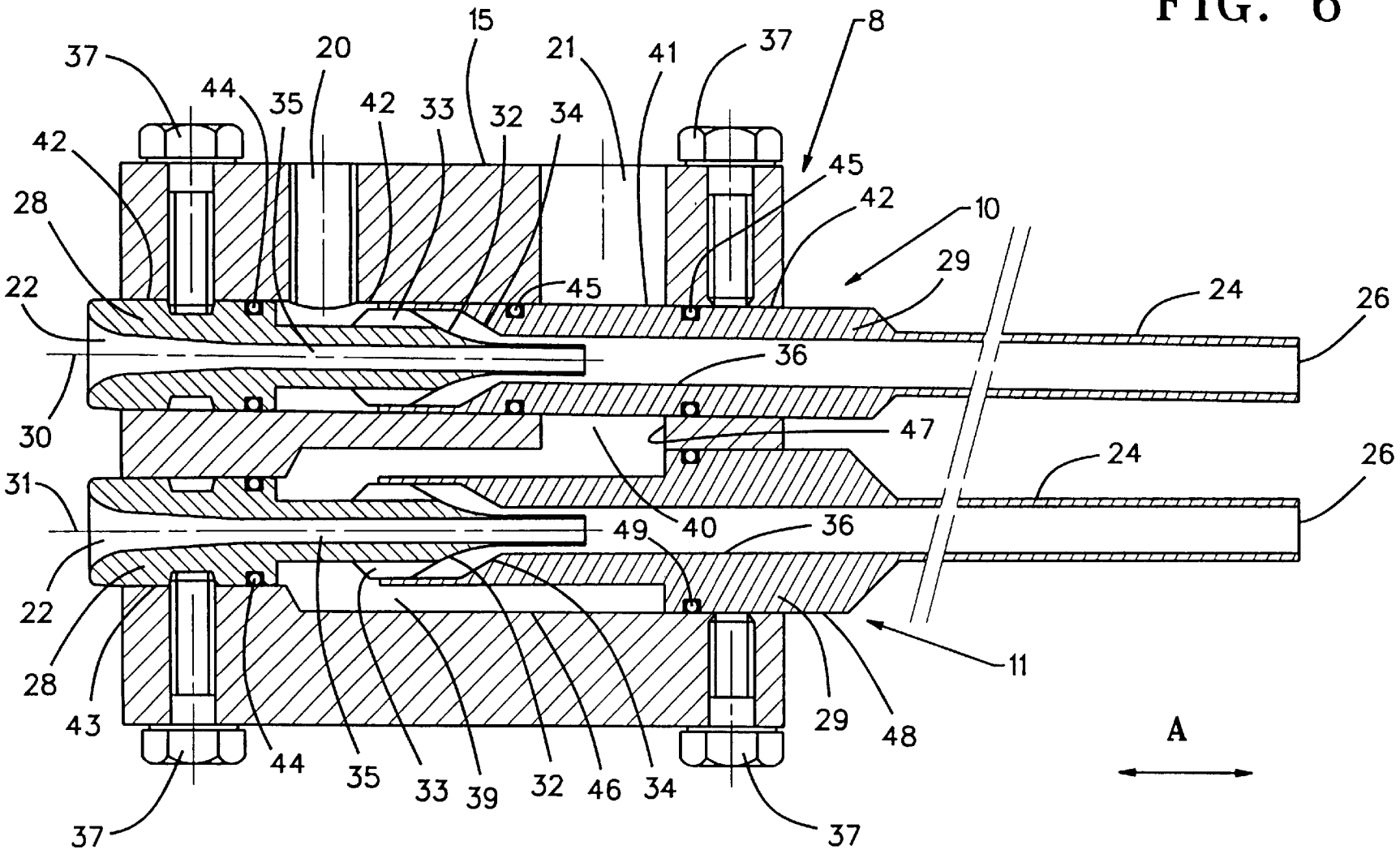
FIG. 6 is a sectional view similar to FIG. 2 of another embodiment.

However, as shown in FIG. 6, the holder 8 may preferably be made in the form of a block and subsequently provided with boreholes. In order to facilitate sufficiently large cross-sections for the channel segments 39, 40, comparatively large boreholes 46, 47 must be provided. In such case, the feed connection 21—which is produced simultaneously with a borehole forming the channel segment 40—must then be provided with a part constituting the actual connection. The guide element 29 of the nozzle 11 comprises an enlarged portion 48 in which the outside diameter corresponds to the borehole 46 that shaped the channel segment 39. An O-ring 49 is present in the zone of the enlarged portion 48. The embodiment of FIG. 6 further differs from that shown in FIGS. 1 through 5 in that the guide tubes 24, 25 are each integral with the guide elements 29. While the external contours of the nozzles 10, 11 of this embodiment of FIG. 6 slightly differ, they match entirely with regard to their internal shapes.

Figure 7:
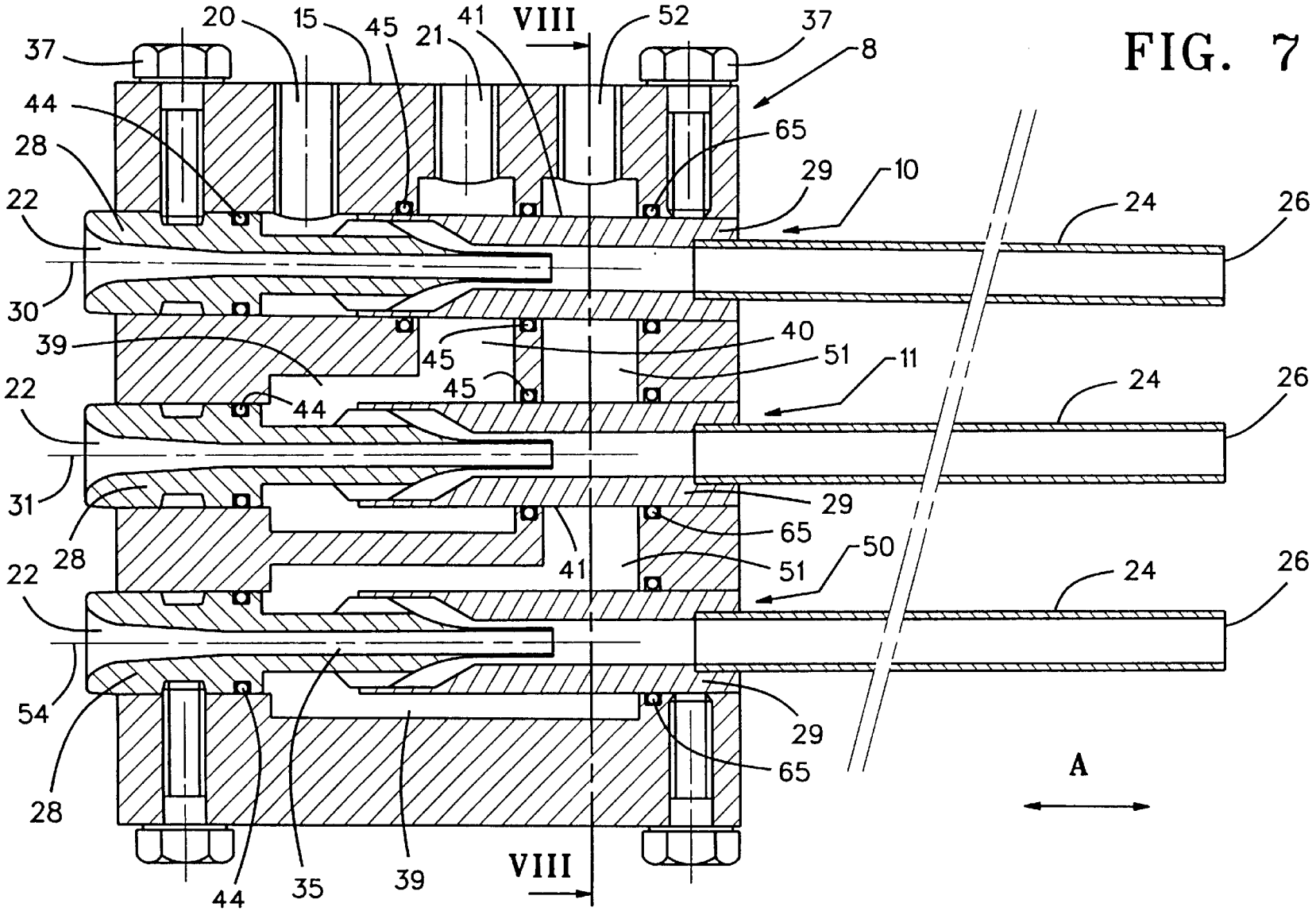
FIG. 7 is a sectional view similar to FIG. 2 of another embodiment.

Three nozzles 10, 11, 50 are superposed in a common plane 53 in the embodiment of FIGS. 7 and 8 and consequently three feed connections 20, 21, 52 are used. The feed connections 20 and 21 communicate with the associated nozzles 10, 11 in the same manner as discussed already in relation to the embodiment of FIGS. 1 through 5. The same references are used and the pertinent description is therefore referred to. The lowermost nozzle 50 is connected by a guide channel of the holder 8 to the feed connection 52, the guide channel consisting of a segment 39 coaxial with the nozzle 50 and of a segment 51 perpendicular thereto.

As shown in FIG. 8 in particular, the segment 51 encloses the nozzles 10 and 11 in the region of the particular guide element 29, and a segment 41 of the guide element 29 is sealed from the outside in the region of the O-rings 44, 65. The axis 54 of the nozzle 50 is in a plane also containing the axes 30, 31 of the nozzles 10, 11 and likewise are the feed connections 20, 21, 52.

When more than three feed connections 10, 11, 50 are mounted in one holder 8, such a design may preferably be carried out in the manner shown in FIG. 7. The particular feed connection associated with the lowermost nozzles communicates through a channel with the lowermost nozzle, where the channel comprises a segment that is perpendicular to the longitudinal axis of the nozzle and encloses all the nozzles located above and being correspondingly sealed by O-rings in the region of the individual nozzles.

With regard to the embodiment of FIG. 9, the longitudinal axes 30, 31 of the superposed nozzles 10, 11 are configured in the plane 38 subtending an angle with the vertical. This feature allows for another configuration of the associated guide tubes 24. The feed connection 21 is positioned centrally in the holder 8 and hence is somewhat offset to the side from the nozzles 10 and 11. The feed connection 20 (not shown) on the other hand, is mounted plumb above the longitudinal axis 30 of the nozzle 10, which is somewhat eccentric relative to the top side 15 of the holder 8. The feed connections 20, 21 are also mounted apart from each other in the direction of the longitudinal axes 30, 31.

As shown in FIGS. 1 and 5, several holders 8 each comprising two nozzles 10, 11 preferably may be mounted immediately adjoining each other. Appropriately the holders 8 taper in the filling direction, that is, the side walls 58, 59 starting from end faces 60 in the zone of filling intake 22 converge toward the guide tube 24. In this manner, the guide tubes 24 of the nozzles 10, 11 can be aligned with the guide channel 4 of the reed. The holders 8 each with two or more nozzles allow modular construction of an insertion system to be matched to the desired operational conditions.

Only one holder 8 that is provided with two nozzles 10, 11 may be sufficient. Preferably however, as shown in FIG. 1, several holders 8 each comprising at least two nozzles 10, 11 will be mounted next to each other—for instance two, three, four or even more holders, whereby it will be feasible to weave with four, six, eight or even more nozzles. The feed connections 20, 21 of all holders 8 are positioned in this configuration on the same side of the holder 8, that is, with regard to the embodiment of FIG. 1, on the top side 15 of each holder 8. Obviously the holders 8 preferably may be mounted not adjacent to one another but for instance, they can be rotated 90° and superposed. In this case the connectors 16, 17 and the feed lines 18, 19 would be positioned on one lateral surface of the holders 8.

Furthermore, it is clearly also possible to house several sets of two superposed nozzles 10, 11 or of three superposed nozzles 10, 11, 50 in an integral holder 8 which in this design will be provided with the channels that are shown in the embodiments of FIGS. 2 through 9. In this case as well, all feed connections 20, 21, 52 of the superposed nozzles 10, 11, 50 are disposed on the same side of the holder 8, the feed connections 20, 21, 52 of one set of nozzles 10, 11, 50 being mounted and spaced apart in each instance in the direction of the longitudinal axes 30, 31, 54 of the nozzles 10, 11, 50 and preferably also in the planes 38, 53 of the longitudinal axes 30, 31, 54. The planes 38, 53 of the various sets of nozzles 10, 11, 50 will then substantially run parallel to each other.

Figure 10:
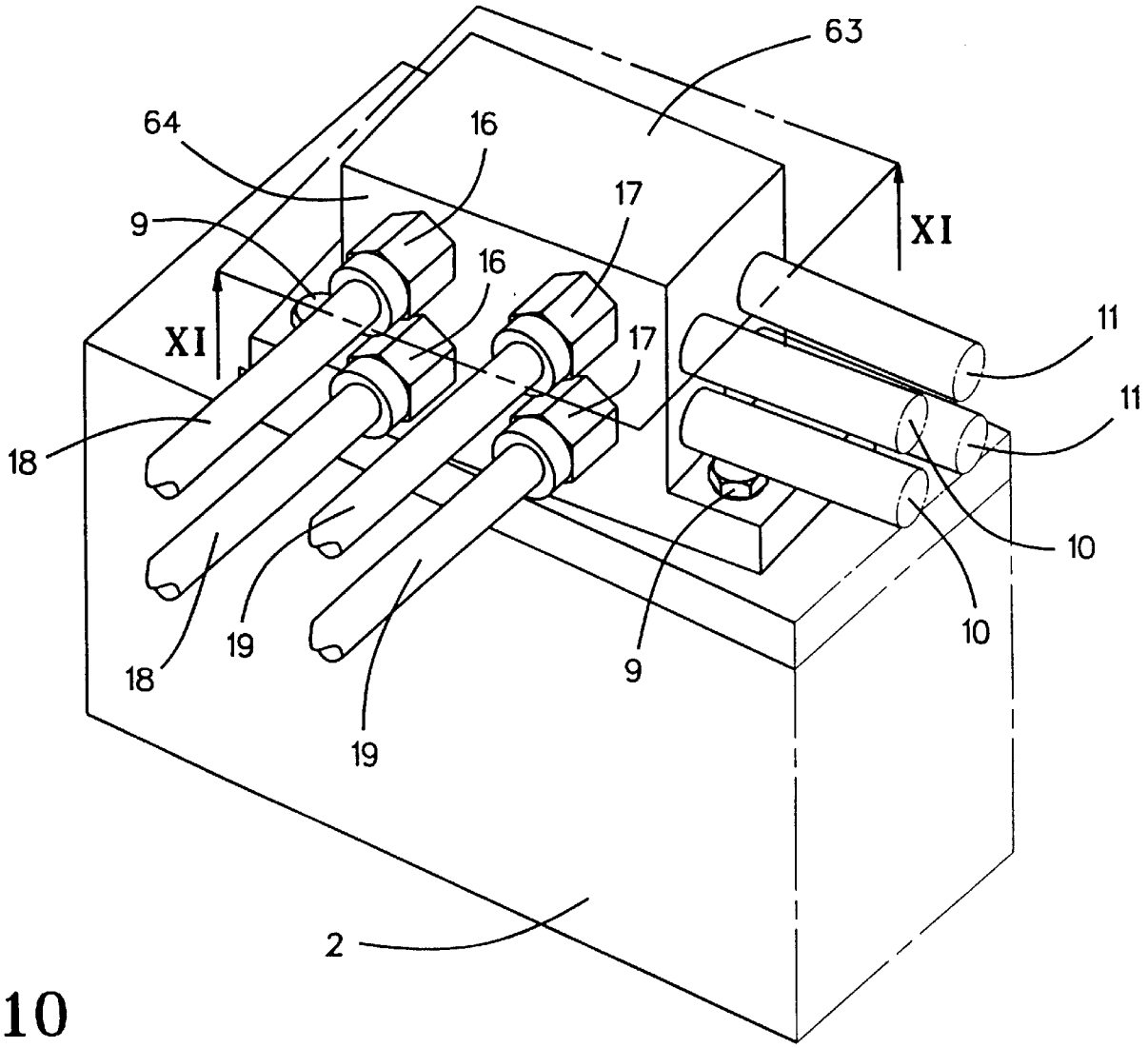
FIG. 10 is a perspective view of yet another embodiment of the invention.
Figure 11:
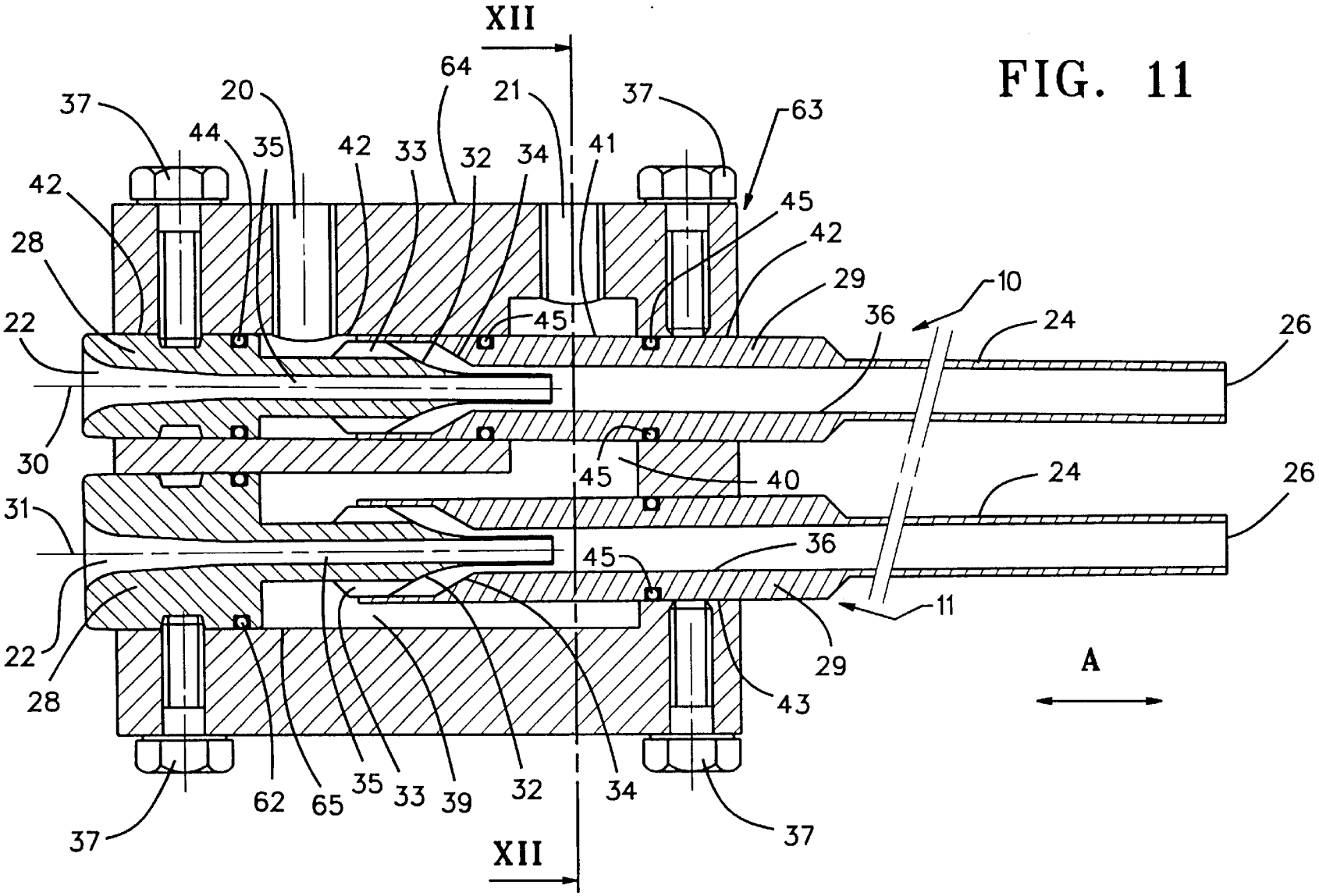
FIG. 11 is a sectional view along plane XI of FIG. 10.
Figure 12:
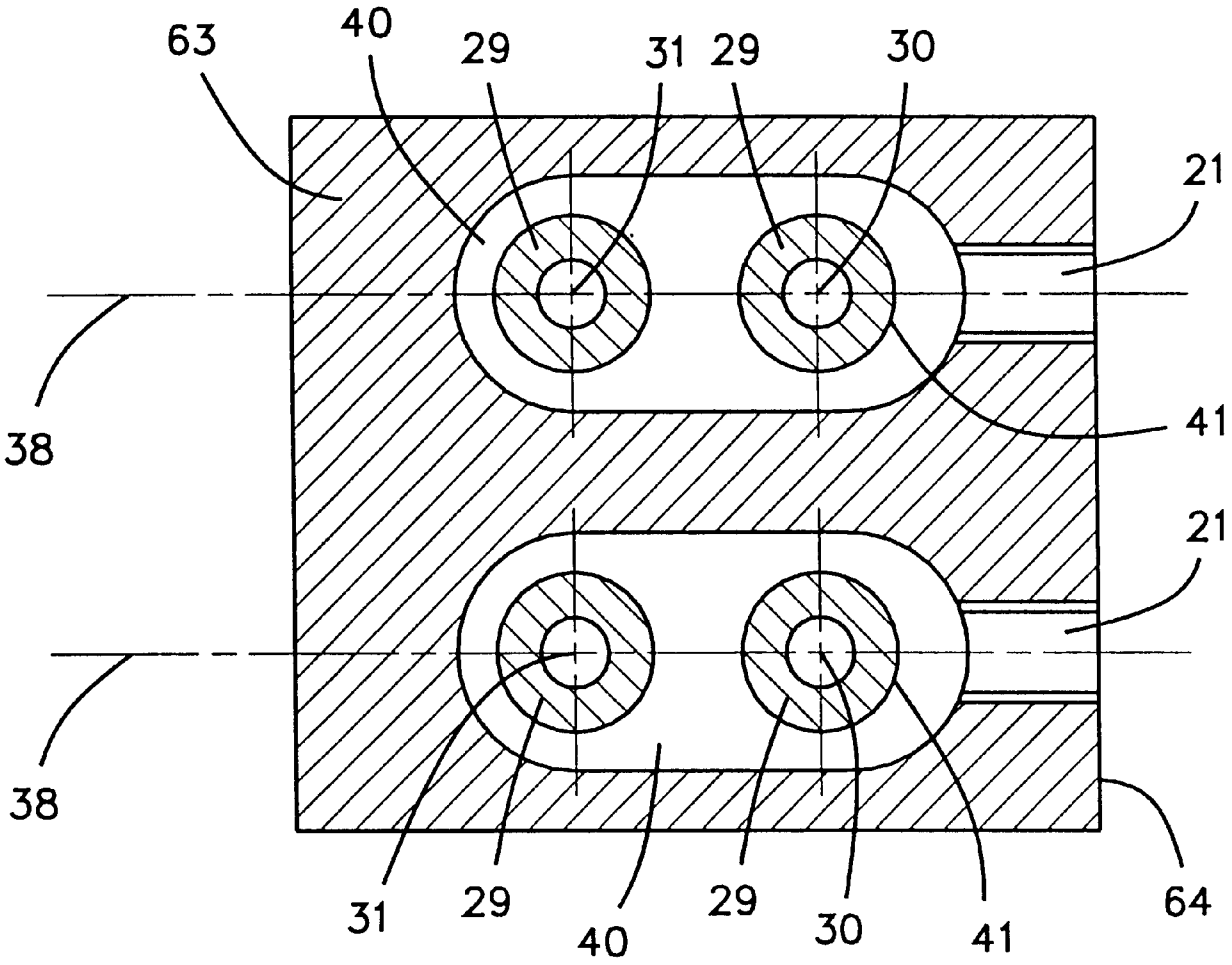
FIG. 12 is a sectional view along line XII—XII of FIG. 11.

With regard to the embodiment of FIGS. 10 through 12, illustratively each two sets of two nozzles 10, 11 are mounted in a common holder 63. The holder 63 is provided in each instance with two feed connections 20, 21 that are positioned on the same surface of the holder 63—in this embodiment, on a lateral surface 64. One feed connection 20 and one feed connection 21 are associated on the lateral surface 64 of each set of two nozzles 10, 11, the feed connections being mutually spaced apart in the direction of the longitudinal axes 30, 31 of the nozzles 10, 11. One guide channel provided with segments 39, 40 is located in the holder 63 for each set of nozzles 10, 11 in order to feed the pressurized fluid from the associated feed connection 21 to the nozzle 11. In this design, the nozzles 10, 11 are adjacent in a plane 38 passing through the longitudinal nozzle axes 30, 31. Associated feed connections 20, 21 are also located in the planes.

As shown in FIG. 11, the nozzles 10, 11 all assume the same internal configuration. The insertion element 28 for the filling threads of the nozzles 11 however differs from the insertion element 28 of the nozzles 10 by having an initial part with an enlarged diameter. The outside diameter of the initial part corresponds to the inside diameter of the borehole 65 within which the channel segment 39 was formed, the channel running from the feed connection 21 to the nozzle 11.

Figure 13:
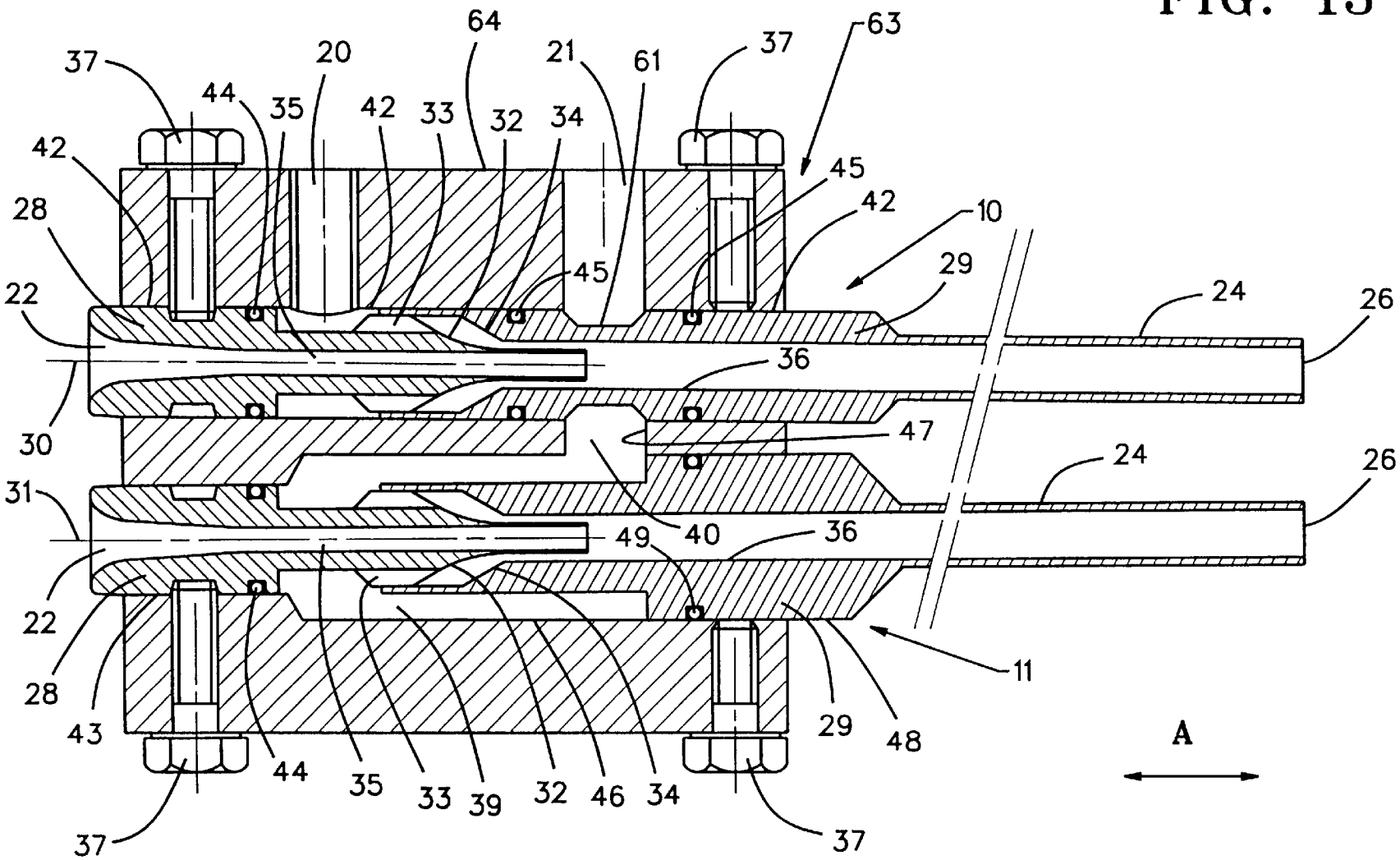
FIG. 13 is a sectional view similar to FIG. 11 of another embodiment.

FIG. 13 shows an embodiment corresponding basically to that of FIG. 6. In order to form the channel segment 40 with a lesser diameter while nevertheless facilitating a sufficient cross-section, the guide element 28 of the nozzle 10 is provided with an annular groove 61 in the region of the borehole 47. Such annular groove 61 preferably may be used in other embodiments, for instance in that of FIG. 8. In such a case and particularly in the region of the channel segment 51, the guide elements 29 of the nozzles 10 and 11 would be provided with corresponding annular grooves 61.

Figure 14:
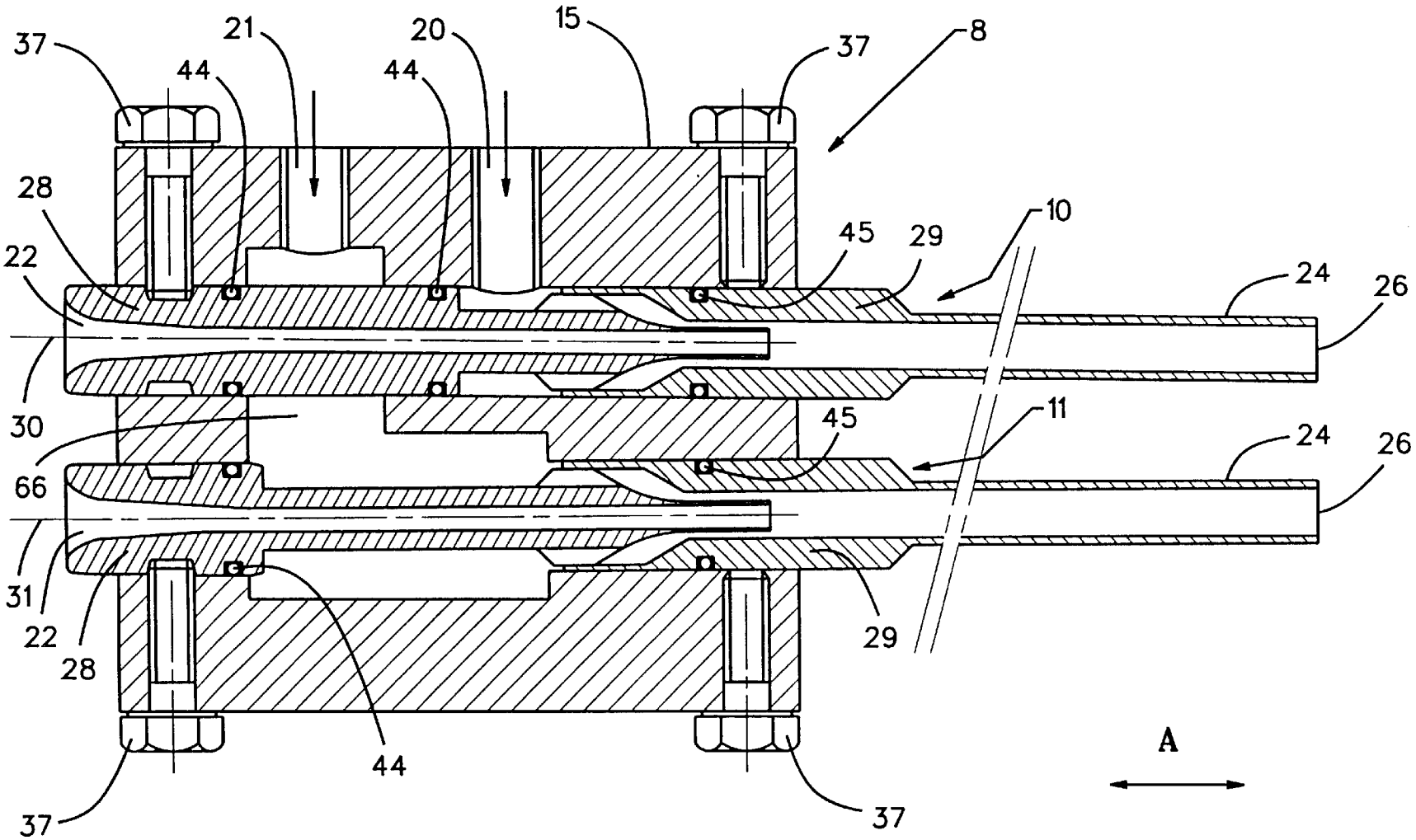
FIG. 14 is a sectional view similar to FIG. 2 of yet another embodiment of the invention.

As shown in FIG. 14, it is possible to interchange the feed connections 20 and 21, that is, to mount the feed connection 21 for the lower nozzle 11 in the region that is closer to the intakes 22 of the guide element 28 and the feed connection 20 for the nozzle 10 in the region located away from these intakes 22. In such a case, an appropriately shaped channel 66 is associated with the lower nozzle 11 in the holder 8. Correspondingly of course, three or more nozzles preferably may be superposed and be fed by the pressurized fluid. Similarly, combinations of the embodiments of FIGS. 2, 6, 7, 11, 13 and 14 preferably may be carried out.

In an embodiment (not shown), a single holder is used for eight nozzles each of which include guide tubes that are configured in the manner of FIG. 1. If the feed connections are configured at the top side of such a holder, each time there will be four sets of two superposed nozzles. If the feed connections are mounted on the lateral side, it is preferred that two sets of four adjacent nozzles be provided. For each set of nozzles, the associated feed connections are configured in the manner of the embodiments of FIGS. 1 through 14, spaced apart in the direction of the longitudinal axes of the sets of nozzles. One or three channels for the supply of pressurized fluid can be provided per set of nozzles and run from the particular feed connection to the nozzles.

The insertion system of the present invention is not restricted to main nozzles of an airjet weaving machine. Illustratively it may also be used for the spray nozzles of a waterjet weaving machine or for other nozzles operating with a fluid other than air or water.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. An insertion system for a weaving machine comprising:

a common holder having a common side;

a plurality of feed connections for a pressurized fluid;

at least two nozzles each having a longitudinal axis and comprising an intake adapted to receive a filling thread, the nozzles connected with one or more of the feed connections, each of the nozzles mounted in the holder;

a plurality of channels provided in the holder, each of the channels extending from at least one of the feed connections to at least one of the nozzles; and the feed connections are located on the common side of the holder and are mutually spaced apart in alignment with and in the direction of the longitudinal axes of the nozzles.

2. The insertion system as claimed in claim 1, wherein the feed connections are disposed in a plane including the longitudinal axes of the associated nozzles.

3. The insertion system as claimed in claim 1, further comprising an annular chamber enclosing the nozzles and wherein the channels extend from the feed connections to the annular chamber.

4. The insertion system as claimed in claim 1, wherein the holder is provided with clearances extending in a filling insertion direction and receiving the nozzles, the holder comprises a segment comprising an injector, the segment is positioned between a filling guide element and a guide tube, the segment being sealed along a longitudinal direction of the clearance from the guide element and the guide tube or a second guide element and communicating through one of the channels with a feed connection.

5. The insertion system as claimed in claim 4, wherein the channel extending from one of the feed connections to one of the nozzles encloses the nozzle or nozzles which is/are positioned closer to the feed connections such that the channel is sealed off in the longitudinal direction of the nozzles.

6. The insertion system as claimed in claim 1, wherein the holder is configured with several sets of the nozzles that are superposed or adjacent to each other in substantially parallel planes.

7. The insertion system as claimed in claim 1, wherein the holder includes two or more superposed or adjacent ones of the nozzles that are configured along a common plane.

8. The insertion system as claimed in claim 7, further comprising several additional holders, each of the holders comprising top sides and at least two nozzles, the holders are mounted next to each other and the feed connections are mounted on the top sides of the holders.

9. The insertion system as claimed in claim 8, wherein the holders when seen from above taper in a filling insertion direction and abut each other on their lateral surfaces.

10. The insertion system as claimed in claim 1, wherein the holder comprise cast or injection molded integral channels.

* * * * *